United States Patent [19]

Lamy

[11] 4,290,716

[45] Sep. 22, 1981

[54] PLATFORM RESTING ON THE BOTTOM OF A BODY OF WATER, AND METHOD OF MANUFACTURING THE SAME

[75] Inventor: Jacques E. Lamy, Fontenay-aux-Roses, France

[73] Assignee: Compagnie Generale pour les Developpements Operationnels des Richesses sous Marines "C. G. Doris", Paris, France

[21] Appl. No.: 27,828

[22] Filed: Apr. 6, 1979

[51] Int. Cl.[3] ..... E02B 17/02

[52] U.S. Cl. ..... 405/203; 52/126; 405/209; 405/225; 405/229

[58] Field of Search ..... 405/195, 196, 203, 204, 405/205, 206, 211, 218, 221, 222, 224, 225, 227, 229; 52/126

[56] References Cited

U.S. PATENT DOCUMENTS

| | | | |
|---|---|---|---|
| 2,210,408 | 8/1940 | Henry | 405/196 |
| 2,602,321 | 7/1952 | Blair . | |
| 2,687,617 | 8/1954 | Newell | 405/221 |
| 2,939,290 | 6/1960 | Crake | 405/205 |
| 3,062,014 | 11/1962 | Newcomb | 405/205 |
| 3,157,254 | 11/1964 | Spiselman et al. | 52/126 X |
| 3,283,515 | 11/1966 | Pottorf . | |
| 3,345,824 | 10/1967 | Turzillo | 405/225 |
| 3,436,920 | 4/1969 | Blenkarn et al. . | |
| 3,683,632 | 8/1972 | van der Veen | 405/225 |
| 3,878,662 | 4/1975 | Cernosek . | |
| 3,927,535 | 12/1975 | Giblon | 405/224 X |
| 4,083,193 | 4/1978 | Evans | 405/204 |
| 4,154,552 | 5/1979 | van Bilderbeek | 405/229 |

FOREIGN PATENT DOCUMENTS

| | | | |
|---|---|---|---|
| 1173704 | 10/1958 | France | 405/229 |
| 1189886 | 4/1970 | United Kingdom | 405/204 |

*Primary Examiner*—David H. Corbin

*Attorney, Agent, or Firm*—Wigman & Cohen

[57] ABSTRACT

A platform resting at the bottom of a body of water, including a plurality of longitudinally disposed bays supported by piers each consisting of a small number of transversely aligned posts resting on a common base and each supporting a cross-beam, each bay comprising a framework of longitudinal beams which rest at either end on the cross-beams, and a method of constructing the platform comprising the steps of preparing each pier onshore, transporting it to the installation site and setting it down on the bottom, raising the base at several points and adjusting their heights above the bottom in order to position the base horizontally, securing the base in that position by pouring concrete beneath it, preparing each bay on the shore, transporting it to the installation site and setting it down on two adjacent piers.

5 Claims, 14 Drawing Figures

XI
XIII

PLATFORM RESTING ON THE BOTTOM OF A BODY OF WATER, AND METHOD OF MANUFACTURING THE SAME

BACKGROUND OF THE INVENTION

This invention relates to a platform of the gravity type, that is, one maintained by virtue of its own weight on the bottom of a body of water, and more particularly to an offshore platform lying on the bottom of a shallow body of water.

Conventional offshore platforms include a structure, usually in the form of a tower, which has a base resting on the bottom and which supports, above the surface of the water, a bridge which in turn supports industrial or scientific installations, an example being equipment for drilling or extraction operations on hydrocarbon wells.

The building of such a platform requires a vast construction site and involves long and complicated operations. Further, such offshore platforms are not extendable, and consequently if the forecasts made at the time a platform was built are exceeded, the original platform must either be replaced by a larger one or have a second one connected to it.

SUMMARY OF THE INVENTION

It is one object of this invention to provide a platform which is readily extendable. Another object is to provide a platform having a construction which requires only a location of moderate size and involves simple and relatively rapid operations. Still another object is to provide a platform capable of being built up from prefabricated elements which can consequently easily be produced in prestressed concrete.

A platform according to this invention includes a plurality of longitudinally disposed bays supported by piers, each consisting of a small number of transversely aligned posts resting on a common base and supporting a cross-beam, each bay having a framework of longitudinal beams resting at either end on the cross-beam. Preferably, the framework additionally includes transverse joists which, together with the longitudinal beams, form a latticework which can be at least partly covered with flooring or flooring elements.

The present invention further relates to a construction method which includes the steps of preparing each pier onshore, transporting it to the site where it is to be set down and causing it to rest on the bottom, raising the base at various points and adjusting the heights thereof above the bottom of the water in order to position the base horizontally, securing the base in this horizontal position by pouring concrete beneath it, for example, preparing each bay on the shore and transporting it to the installation site, and thereafter setting it on two adjacent piers.

Preferably, the preparation of the piers includes the provisional fixing of the cross-beams on top of the posts and, prior to placement of the bays, the position of the cross-beams is so adjusted as to cause their upper surfaces to lie in the same horizontal plane, after which they are secured in position and fixed definitively to the posts in this position.

In order to enable them to be transported up to the installation site and set down on the bottom, the piers are preferably equipped with ballastable floats and are placed on an "over-immersible" barge, that is, a barge having a degree of immersion which can be varied by ballasting it to a lesser or greater extent. At the installation site, the barge is weighted so that it rides low enough in the water for the pier which it is carrying to begin to float, after which the barge is towed to the shore and the pier floats are ballasted to cause the pier to rest on the bottom. Both this particularity of the method and the "over-immersible" barge form part of the present invention.

Once the bays are in position, the platform can be equipped. Such equipment may include risers, namely pipes connecting the platform deck to the bottom. In order to protect these risers against shocks, recourse is preferably had to protective means comprising vertical casings through which extend stakes driven into the water bed. Assembly is effected by resting the protection on the bottom and using the casings as guides for driving in the stakes or for drilling holes into which the stakes are then engaged. Such protective means and its method of assembly likewise form part of this invention.

The description which follows with reference to the accompanying non-limitative exemplary drawings will give a clear understanding of how the invention can be carried into practice.

DETAILED DESCRIPTION OF THE PREFERRED EMBODIMENT

Figure 1:
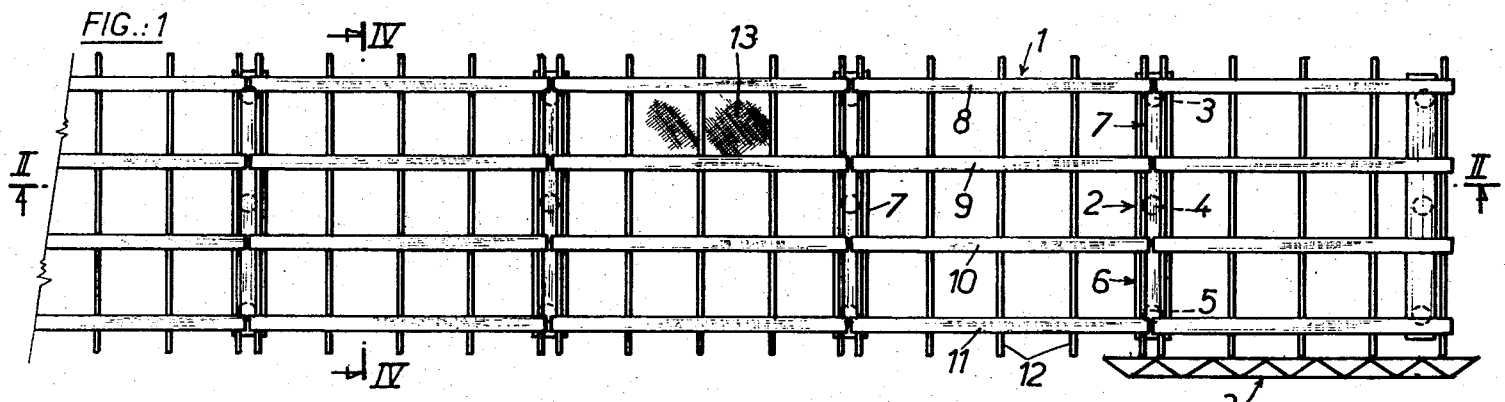
FIG. 1 is a plan view of a platform made according to this invention.
Figure 2:
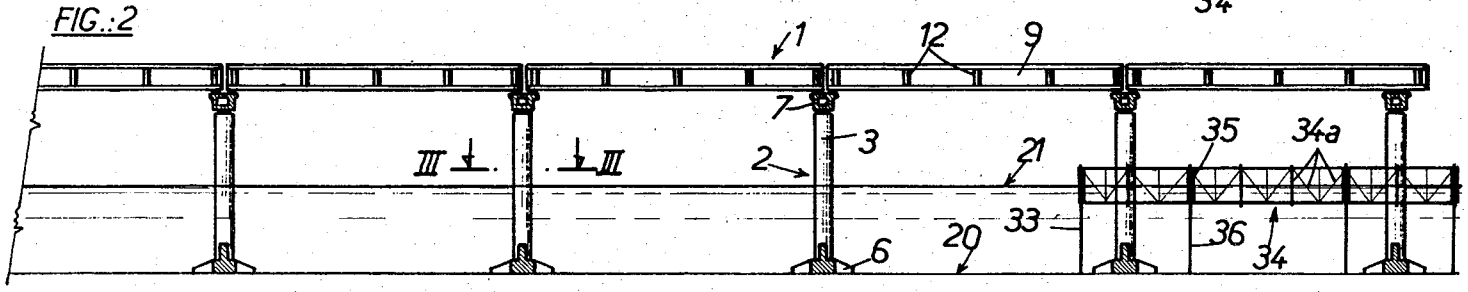
FIG. 2 is a sectional view through the line II—II of FIG. 1.
Figure 4:
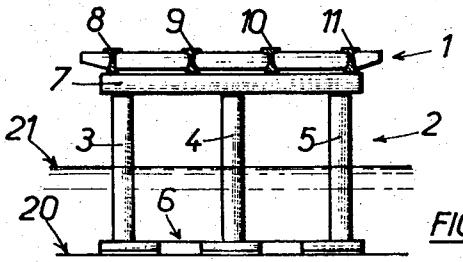
FIG. 4 is a sectional view through the line IV—IV of FIG. 1.
Figure 3:
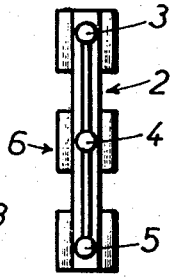
FIG. 3 is a sectional view through the line III—III of FIG. 2.

The platform shown in FIGS. 1 to 4 is an offshore platform resting on a seabed about twelve meters deep, for use in extraction operations from previously drilled oil-wells. It includes a bridge structure extending above the water surface and is composed of a plurality of bays 1, disposed longitudinally and supported by an underframe structure composed of piers 2, each of which is formed by three transversely aligned posts 3, 4, 5 resting on a common base 6 and supporting a cross-beam 7.

Each bay 1 comprises a framework span made up of four longitudinal beams 8, 9, 10, 11 which, together with transverse joists 12, form a latticework which can be covered, at least partly, with flooring or flooring elements, such as elements 13. The longitudinal beams 8–11 of each bay 1 rest at either end on cross-beams 7 of two adjacent piers 2. The bay framework is intended to support production gear (pumps, separators, compressors, etc.) shown only partially on the drawings. Each bridge span or bay framework is a generally planar, i.e., substantially two-dimensional, horizontally oriented structure. Each pier 2 is a generally planar, i.e., substantially two-dimensional, vertically oriented structure.

Figure 5:
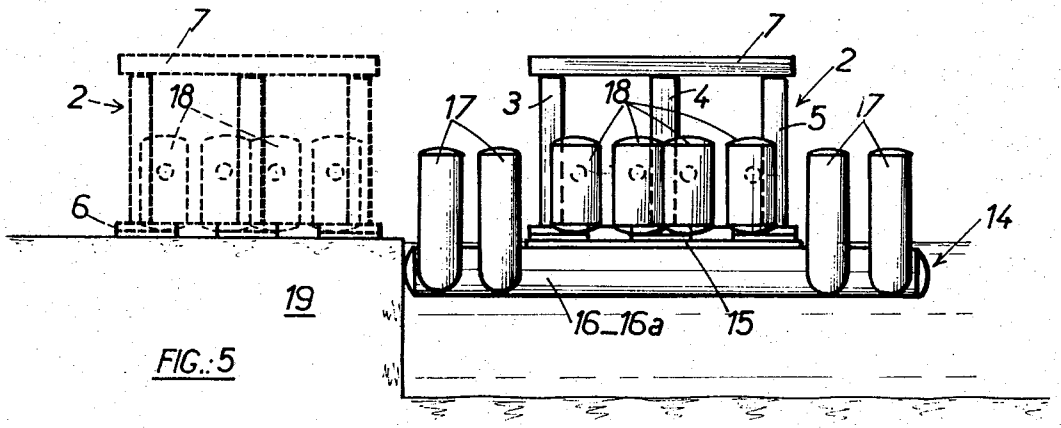
FIG. 5 is a side elevation view showing the loading of a pier on an over-immersible barge.
Figure 6:
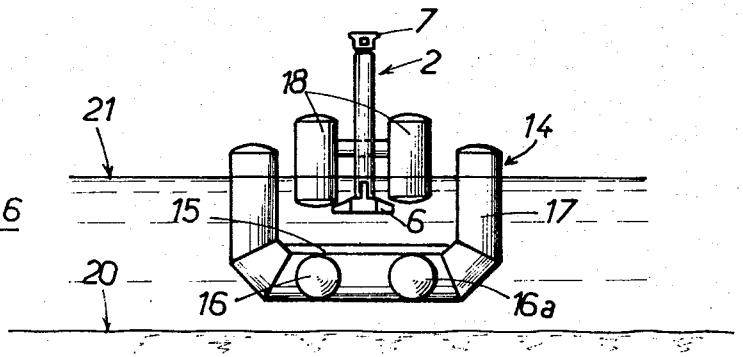
FIG. 6 is an end view showing a pier floating and the barge in its over-immersed position.

The piers 2 are constructed on shore, preferably in a workshop, thus enabling them to be readily fabricated from prestressed concrete without the need for the complicated apparatus required to set the reinforcements under tension on a work-site. The posts 3, 4, 5 of each pier are fixed to the base 6 thereof, but cross-beam 7 is temporarily fixed to the tops of the posts. FIG. 5 illustrates the manner of loading a pier on an over-immersible barge 14 which includes (see also FIG. 6) a deck 15 supported by two tubular floats **16, 16*a* fixed at either end to a tubular U-shaped float 17 with upwardly extending arms. Ballasting means (not shown) enable water to be admitted into the floats 16, 16*a* and 17 or to be expelled therefrom in order to vary the degree of immersion of the barge 14. Pier 2 is equipped with floats 18 formed by hollow cylinders fixed vertically against the posts 3, 4, 5 and likewise comprising ballasting means (not shown), after which the pier 2 equipped thus is deposited on a quay 19 (the position shown in dash lines in FIG. 5). Barge 14 is moved against quay 19, after which its floats 16, 16*a* and 17 are filled with the amount of water required to bring its deck 15 level with quay 17. The pier 2 can then be slid onto deck 15 or caused to roll thereon on rollers (not shown). Barge 14 is then towed to the platform installation site, the floats 16, 16*a* and 17 are once more ballasted until barge 14 sinks low enough for pier 2 to be kept afloat by its floats 18, after which barge 14 is evacuated and towed to the shore to be loaded with another pier 2. Pier 2 is then moved vertically above its definitive location and the floats 18 are gradually ballasted until base 6 rests on the seabed 20. The U-shaped floats 17 protrude from the water when the barge is partially sunk (FIG. 6) and that the height of piers 2 is greater than the sea depth at the installation site, whereby floats 18 still rise above the surface 21 of the sea when base 6 rests on seabed 20 (see FIG. 4). The barge 14 and pier 2 equipped with its floats 18** thus float in stable fashion while the operations hereinbefore described are performed.

Figure 7:
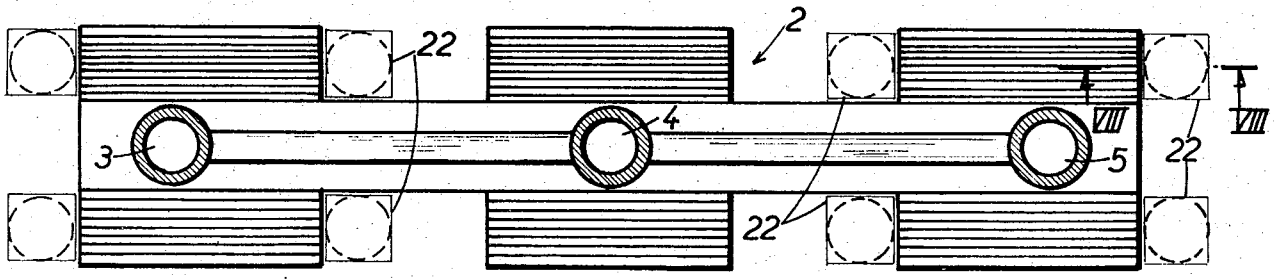
FIG. 7 is a view corresponding to FIG. 3, showing on an enlarged scale the base of a pier equipped with levelling jacks.
Figure 9:
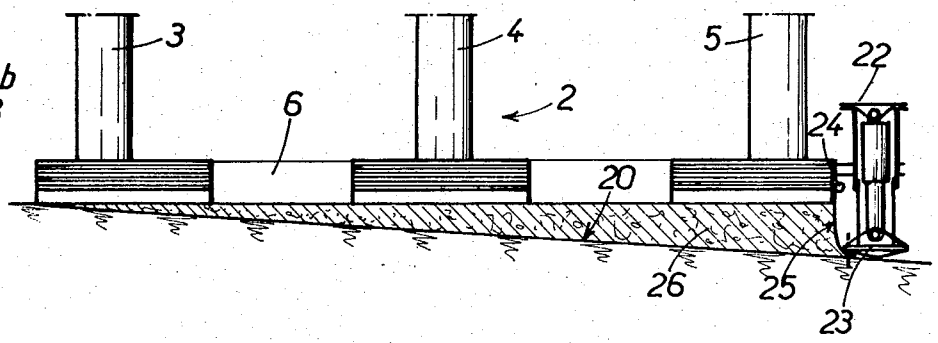
FIG. 9 is a diagrammatic view on a different scale, illustrating the securing or wedging of the base.
Figure 8:
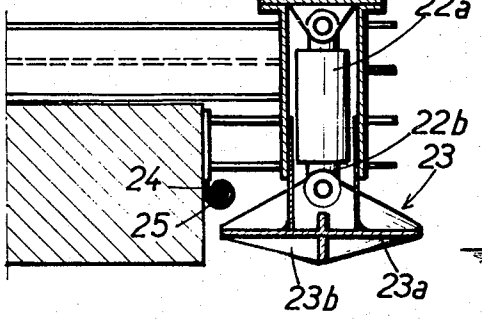
FIG. 8 is a sectional view through the line VIII—VIII of FIG. 7, illustrating the levelling of the base.

The seabed 20 is not as a rule very horizontal, and FIGS. 7, 8 and 9 illustrate means used to ensure that the pier 2 is nevertheless supported on the seabed 20 with its base 6 horizontal and the posts 3, 4, 5 consequently truly vertical. Hingedly connected to each end of base 6 are the cylinders **22*a* of four jacks 22; to the end of the rod 22*b* of each such jack is hingedly connected a supporting member 23 which includes a plate 23*a* the undersurface of which bears a spade 23*b* designed to anchor into the seabed. The periphery of base 6 is provided with rolls 24 onto which are rolled porous sheets 25, manufactured under the brand name Filter-X by the American firm, Carthage Mills Inc., Cincinnati, Ohio (United States), and distributed in France by the Sindic company, 16 rue Jean Mermoz, Paris. These sheets 25 are made of porous plastic material which retain particles with a dimension in excess of 0.088 mm in a turbulent water stream, and retain even finer particles in a laminar flow of water. Such porous sheets 25** are commonly used to allow the foundations of constructions on land to drain without causing undermining by water.

The jack cylinders **22*a* can be fed with hydraulic fluid through flexible lines (not shown) long enough to enable the jacks 22 to be actuated from the surface of the sea. After the base 6 has been set down on an inclined seabed (depicted schematically by reference numeral 20 in FIG. 9), the jacks 22 are operated from a craft (not shown) floating on the surface 21 of the water, in order to position the base 6 horizontally. A team of divers then unwinds the porous sheets 25 and secures their ends to the seabed 20, thereby to enclosing the space 26 between base 6 and seabed 20. Concrete is then injected into the space 26 through a pipe leading from the craft on the water surface 21. Porous sheets 25 allow any surplus water to drain from the concrete yet maintain the concrete in position until it has set, after which the jacks 22** can be recovered.

When all the piers 2 have been adjusted accordingly cross-beams 7 will be properly horizontal but not at the same level as a rule. The upper faces of posts 3 and 5 are formed with symmetrical indents 27 and 28 respectively (see FIGS. 10 and 11), and disposed in each of these indents 27 and 28 is a hydraulic jack 29 which acts between the bottom of the indent 28 and the undersurface **7*a* of cross-beam 7. Accordingly the temporary attachments (not shown) joining beam 7 to the tops of the posts 3–5 are removed and the jacks 29 are activated by means well known per se (not shown) in order to set the upper surfaces 7*b* of all the cross-beams 7 in the same horizontal plane. Thereafter, the cross-beams 7 are maintained in this position by means of wedges 30, the jacks 29 are removed for further use, and cross-beam 7 is positively fixed to the tops of the posts 3–5, for instance, by injecting concrete, as depicted in dashed lines at the top of post 5**.

Figures 10, 11, 12, 13, 14:
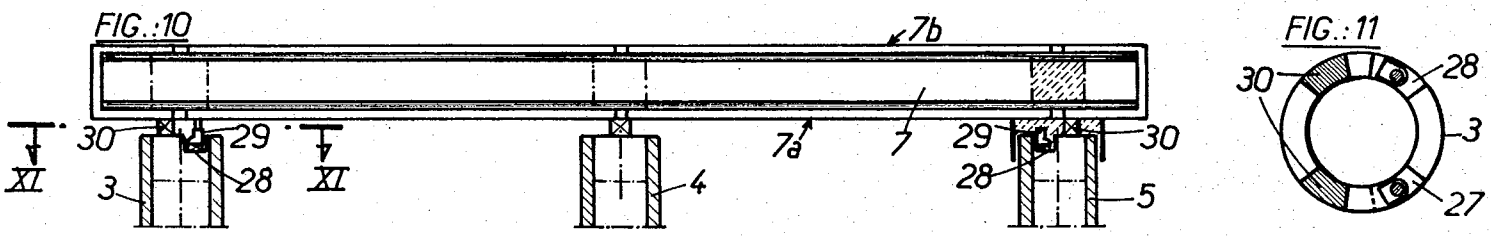
FIG. 10 is a view corresponding to part of FIG. 4, illustrating on an enlarged scale the levelling and securing of a cross-beam.
FIG. 11 is a sectional view through the line XI—XI of FIG. 10.
FIG. 12 is a view corresponding to FIG. 2, on an enlarged scale, illustrating the positioning of a bay.
FIG. 13 is a plan view along the arrow XIII of FIG. 12.
FIG. 14 is a view corresponding to FIG. 4, illustrating the assembly of protective means.

The bays 1 are fabricated on shore, for example, from prestressed concrete like the piers 2, after which each bay 1 is set down on the quay 19 (a position not shown) and thereafter pushed from there onto a trellis support 31 placed on a barge 32 equipped with ballastable floats (not shown) for adjusting its degree of immersion (see FIGS. 12 and 13). The bay 1 is placed transversely on barge 32, the width of which barge 32 is less than the inner gap between two adjacent piers 2, whereby the ends of the bay 1 project from either side of the barge 32. The barge 32 is towed to the installation site, its degree of immersion is adjusted so that the undersurfaces of longitudinal beams 8, 9, 10, 11 are at a slightly higher level than that of the upper surfaces **7*b* of cross-beams 7, the barge 32 is maneuvered between the two adjacent piers 2 so that bay 1 is placed above its ultimate resting position, and thereafter the barge 32 is ballasted so that the bay 1 comes to rest on cross-beams 7 in that position, after which the barge 32 can be disengaged and towed to shore to load another bay 1**.

After construction of the platform has been completed, the floorings or partial floorings 13 are laid and the platform is equipped. Such equipment is represented only on the right-hand bay 1 in FIGS. 1 and 2 and is shown as including risers 33 (that is, tubes connecting the platform deck to the seabed 20). These risers 33 are protected by means 34 formed by trellis-work bars **32*a* interconnecting vertical casings 35 through which extend stakes 36 driven into the seabed 20. FIG. 14 illustrates the manner of assembling the protective means 34, which manner comprises the steps of setting the trellis-work bars 34***a* on the seabed 20 vertically in line with the location it is to occupy, drilling holes 37 into the seabed 20 with rods 38 driven by gear 39 cantilevered from the bridge of the platform and movable therealong, driving the stakes 36 (see FIG. 2 again) into the holes 37, raising the assembled trellis-work bars 34 level with the water surface 21, and securing the bars 34*a* in that position.

Changes and substitutions of parts may be made to the form of the embodiment, hereinbefore described by way of example, without departing from the scope of the invention. More specifically, instead of using a variable-immersion barge 32 as shown in FIG. 12, a barge equipped with lifting means or jacks for adjusting the level of bays 1 may be used.

I claim:

1. An offshore platform of the "gravity" type being designed for lying by virtue of its own weight on the bottom of a body of water and being composed basically of an underframe structure resting on the bottom of the body of water and supporting a bridge structure above the surface of the body of water, wherein:

said underframe structure comprises a plurality of longitudinally-spaced and transversely-extending piers, each of the plurality of piers including a pluraity of transversely-spaced upright posts in mutual transverse alignment, a common transverse base resting on the bottom of the body of water and carrying lower ends of the upright posts, and a common cross-beam overtopping upper ends of the upright posts, whereby an assembly of said upright posts, said base, and said cross-beam form together each of the plurality of piers in a vertically oriented, generally planar, and substantially two-dimensional array, and said bridge structure comprises a longitudinal plurality of bays, each of the plurality of bays including a plurality of transversely spaced and longitudinally-extending beams which rest upon cross-beams of the piers, and a plurality of longitudinally-spaced and transversely-extending joists interconnecting said beams whereby an assembly of said beams and said joists form together each of the plurality of bays in a horizontally oriented, generally planar, and substantially two-dimensional array.

2. The platform, as recited in claim 1, wherein each of the plurality of bays further includes flooring elements fitted between said beams and said joists.

3. The platform, as recited in claim 1, wherein each of the plurality of piers further includes means for positively securing said common transverse base in a substantially horizontal position on a nonhorizontal bottom of the body of water.

4. The platform, as recited in claim 3, wherein each of the plurality of piers further includes means for positively maintaining an upper face of the cross-beam in a horizontal plane.

5. A process for setting up an offshore platform of the "gravity" type designed for lying by virtue of its own weight on the bottom of a body of water and composed basically of an underframe structure resting on the bottom of the body of water and supporting a bridge structure above the surface of the body of water, wherein said process comprises the steps of:

constructing at an onshore location a plurality of piers as separate and independent structural assemblies;

floating the piers from the onshore location to an offshore site;

laying the piers at the offshore site in a longitudinally-spaced distribution and in a substantially vertical transverse arrangement, with bases of the plurality of piers resting transversely on the bottom of the body of water and with posts sticking upright partially above the surface of the body of water so that cross-beams of the piers extend completely above the surface of the body of water in order to expose upwardly-directed faces;

adjusting the height of the piers so that the upwardly directed faces of the cross-beams lie in a single horizontal plane;

constructing at the onshore location a plurality of bays as separate and independent structural assemblies;

floating the bays from the onshore location to the offshore site; and laying each of the plurality of bays on the upwardly-directed faces of the cross-beams of two consecutive piers, so that each of the plurality of piers supports adjacent ends of two bays.

* * * * *